US005594531A

United States Patent [19]

Shishido et al.

[11] Patent Number: 5,594,531

[45] Date of Patent: Jan. 14, 1997

[54] ELECTROPHOTOGRAPHIC APPARATUS EMPLOYING CYLINDRICAL MEMBER HAVING SPACE CONTROLLING MEMBER AND PRESS-FITTED FLANGE

[75] Inventors: Kazuo Shishido, Kawasaki; Shinichi Sasaki, Fujisawa; Koji Miura, Sagamihara, all of Japan

[73] Assignee: Canon Kabushiki Kaisha, Tokyo, Japan

[21] Appl. No.: 573,585

[22] Filed: Dec. 15, 1995

Related U.S. Application Data

[63] Continuation of Ser. No. 977,868, Nov. 17, 1992, abandoned.

[30] Foreign Application Priority Data

Nov. 20, 1991 [JP] Japan ..... 3-329751

[51] Int. Cl.[6] ..... G03G 5/00

[52] U.S. Cl. ..... 399/159; 29/895.22; 492/18; 399/286

[58] Field of Search ..... 355/200, 211, 355/245, 251, 259, 261; 118/651, 656, 657, 658, 661; 29/469.5, 507, 512, 523, 525, 895.2, 895.22; 492/17, 18, 27, 47

[56] References Cited

U.S. PATENT DOCUMENTS

| | | | |
|---|---|---|---|
| 3,015,305 | 1/1962 | Hall et al. | 118/637 |
| 4,003,334 | 1/1977 | Samuels et al. | 118/658 |
| 4,325,627 | 4/1982 | Swidler et al. | 355/256 X |
| 4,376,579 | 3/1983 | Wakao | 355/211 |
| 4,527,883 | 7/1985 | Kamiyama | 355/211 |
| 4,561,763 | 12/1985 | Basch | 492/47 X |
| 4,769,897 | 9/1988 | Moseman | 29/525 |
| 4,794,894 | 1/1989 | Gill | 29/525 X |
| 4,839,690 | 6/1989 | Onoda et al. | 355/211 |
| 4,850,095 | 7/1989 | Akao et al. | 29/525 X |
| 4,935,778 | 6/1990 | Mochida | 355/211 |
| 5,148,220 | 9/1992 | Hilbert et al. | 355/245 |
| 5,151,734 | 9/1992 | Tsuda et al. | 355/200 |
| 5,151,737 | 9/1992 | Johnson et al. | 492/47 X |

FOREIGN PATENT DOCUMENTS

| | | |
|---|---|---|
| 0389267 | 9/1990 | European Pat. Off. . |
| 2630364 | 10/1989 | France . |
| 58-108562 | 6/1983 | Japan . |

*Primary Examiner*—Robert Beatty
*Attorney, Agent, or Firm*—Fitzpatrick, Cella, Harper & Scinto

[57] ABSTRACT

A cylindrical member such as a developing roller or photosensitive drum has a sleeve, a flange at the end portion of the sleeve, and a space-controlling member provided at the end portion of the sleeve. The flange is press-fitted into the end portion of the sleeve to be bonded to the sleeve. A space-controlling portion of the space-controlling member is located further from the end of the sleeve than the press-fitted portion of the flange.

21 Claims, 4 Drawing Sheets

ELECTROPHOTOGRAPHIC APPARATUS EMPLOYING CYLINDRICAL MEMBER HAVING SPACE CONTROLLING MEMBER AND PRESS-FITTED FLANGE

This application is a continuation of application Ser. No. 07/977,868, filed on Nov. 17, 1992, now abandoned.

BACKGROUND OF THE INVENTION

1. Field of the Invention

The present invention relates to a cylindrical member which includes a sleeve, a flange fitted and bonded into the end portion of the sleeve, and a space-controlling member provided at the end portion of the sleeve for controlling the space between the peripheral face of the sleeve and another member. The present invention also relates to a developing roller and a photosensitive drum of an image forming apparatus that employs the above cylindrical member for electrophotography, and further to an electrophotographic apparatus equipped with the developing roller or a photosensitive drum.

2. Related Background Art

Conventionally, a developing roller of a development device of a conventional image-forming apparatus, as shown in FIG. 5, comprises a cylindrical sleeve 12*a*, and a developing roller flange 12*b* bonded permanently at the end portion thereof. At the fitting portion, the inside diameter of the sleeve 12*a* is larger than the outside diameter of the flange 12*b*, usually by approximately 30 μm, for the purpose of applying a prescribed amount of an adhesive 9 between the sleeve 12*a* and the flange 12*b* for bonding them.

The bonding is practiced specifically such that an adhesive 9 is applied uniformly onto the inside peripheral face of the end portion of the sleeve 12*a* where the flange 12*b* is fitted, then the flange 12*b* is inserted thereto, and the adhesive 9 is completely cured at a constant temperature and humidity. Usually, the adhesive includes instantaneous adhesives, and combinations of an adhesion primer and an anaerobic adhesive. The adhesive is selected depending on the required bonding strength for the use and the purpose.

The above constitution of conventional developing rollers has disadvantages shown below.

(1) When the adhesive is applied and completely cured at a high temperature and a high humidity (e.g., at a temperature of 32.5° C., and a relative humidity of 85%), the moisture in the air affects adversely the adhesion during the curing process, causing unstable bonding such as may result in separation of the sleeve and the flange, and slippage between them owing to the deterioration of the adhesion.

(2) Some adhesives require a very long time for complete curing, which necessitates use of a storage space for a long time, and installation for keeping a constant temperature and a constant humidity of the storage environment, and therefore is disadvantageous from the standpoint of cost, management and productivity.

(3) Conventionally, the constitution around the developing roller is as shown in FIG. 2, comprising a magnet roller 14, a developing sleeve 12*a*, a developing roller flange 12*b*, a spacer roller 18, a developing roller bearing 16, a developing roller gear 17, a holder 15, a photosensitive drum 1, and a photosensitive drum gear 1*b*.

In FIG. 2, the flange 12*b* is inserted into the sleeve 12*a* with a gap, and is bonded by use of an adhesive. Therein the magnet roller 14 is enclosed. The developing roller is supported at both ends thereof by the bearings 16. The bearing is fixed on the holder 15 by a positioning pin and a hole which are not shown in the drawing. The magnet roller is also fitted to the holder 15. On the other hand, the photosensitive drum comprises the sleeve 1*a* and the gear 1*b* which are bonded with an adhesive. The developing roller and the photosensitive drum are pressure-contacted through the spacer roller 18 by aid of a spring 8. The spacer roller keeps constant the distance between the developing roller and the photosensitive drum. The photosensitive drum is rotated by receiving rotational driving force from the main body of an image-forming apparatus through the gear 1*b* to rotate the developing roller in the direction indicated by the arrow, through the developing roller gear 17.

Therefore, if the sleeve 12*a* and the developing roller flange 12*b* are not coaxial and deviate from each other by the distance A as shown in FIG. 5, then the outside diameter of the flange 12*b* swings with an amplitude of twice the dimension A relative to the outside diameter of the sleeve 12*a* when the developing roller is rotated through the developing roller gear 17 by the driving action of the photosensitive drum gear 1*b*. Accordingly, the magnet roller 14 moves by a distance of twice the distance A in one rotation relative to the surface of the photosensitive drum 1. As the result, the magnetic force exerted on the photosensitive drum swings, causing irregularity of image density corresponding to the rotation cycle of the developing roller.

SUMMARY OF THE INVENTION

An object of the present invention is to provide a cylindrical member which exhibits stable rotational performance without axial deviation.

Another object of the present invention is to provide a developing roller which exhibits stable rotational performance by keeping a constant distance from a photosensitive member without axial deviation.

A further object of the present invention is to provide a photosensitive drum which exhibits stable rotational performance by keeping a constant distance from a developing roller without axial deviation.

A still further object of the present invention is to provide an electrophotographic apparatus provided with the above developing roller or the photosensitive drum.

According to an aspect of the present invention, there is provided a cylindrical member having a sleeve, a flange bonded to the end portion of the sleeve, and a space-controlling member provided at the end portion of the sleeve, in which the flange is press-fitted into the end portion of the sleeve to be bonded thereto, and a space-controlling portion of the space-controlling member is located more apart from the end of the sleeve than the press-fitted portion of the flange.

According to another aspect of the present invention, there is provided an electrophotographic apparatus comprising a developing roller and a photosensitive drum, wherein the above cylindrical member is employed as the developing roller, and the photosensitive drum is press-contacted to the space-controlling portion.

According to still another aspect of the present invention, there is provided a facsimile machine comprising an electrophotographic apparatus mentioned above, and an information-receiving means for receiving image information from a remote terminal.

According to a further aspect of the present invention, there is provided an electrophotographic apparatus comprising a photosensitive drum and a developing-agent-supporter; the photosensitive drum having a sleeve, a flange press-fitted into the end portion of the sleeve, and a space-controlling member provided at the end portion of the sleeve; a space-controlling portion of the space controlling member being located between the press-fitted portion of the flange and the developing region on the peripheral face of the photosensitive member; and the developing-agent-supporter being press-contacted to the space-controlling portion.

According to a still further aspect of the present invention, there is provided a facsimile machine comprising the electrophotographic apparatus mentioned above, and an information-receiving means for receiving image information from a remote terminal.

DESCRIPTION OF THE PREFERRED EMBODIMENT

The present invention provides a cylindrical member which comprises a sleeve, a flange forced into the end portion of the sleeve and bonded thereto, and a space-controlling member provided at the end portion of the sleeve and having the space controlling portion located apart from the end portion.

The present invention also provides an electrophotographic apparatus employing a photosensitive drum and/or a developing roller having the cylindrical member of the above construction. In the photosensitive drum or the developing roller of the developing device of the electrophotographic apparatus, the portion of the flange to be press-fitted into the end of the sleeve has an outside diameter larger than the inside diameter of the sleeve, and is forced into the sleeve to be bonded thereto.

The outside diameter of the sleeve is expanded by forced insertion of the flange, but the expanded portion of the sleeve in the axis direction does not reach the contact portion of the spacer roller. The difference between the inside diameter of the sleeve and the outside diameter of the flange, and the press-fitting length are selected such that no gap is formed between the flange and the sleeve on thermal contraction and the required rotational strength is obtained. The deviation of the axis from the rotation axis as is met in conventional cylindrical members can be avoided and stable rotation state can be obtained invariably by press-fitting the flange into the sleeve without a gap therebetween and by keeping the expanded portion of the sleeve so as not to reach the portion of the space-controlling member for contacting with another member.

Use of the cylindrical member of the present invention as a developing roller or a photosensitive drum gives the effects as below.

1. The absence of a gap between the sleeve and the flange at the fitting portion ensures the concentricity of the two axes, and obviates swing of the flange relative to the sleeve surface, keeping the magnet roller at the fixed position and eliminating non-uniformity of image density in the rotation cycle of the developing roller.

2. The absence of adhesive or the like improves and stabilizes the quality of the bonding between the sleeve and the flange, and simplifies the assembly process, lowering the production cost.

By press-fitting of the flange into the sleeve, the sleeve is expanded in the radial direction. The height of the expansion is preferably not more than 80 μm, more preferably not more than 50 μm. The press-fitting length is preferably in the range of from 5 to 50 μm, more preferably from 40 to 150 μm, particulary preferably from 60 to 120 μm.

The present invention is explained by reference to the drawings.

First Embodiment

Figure 1:
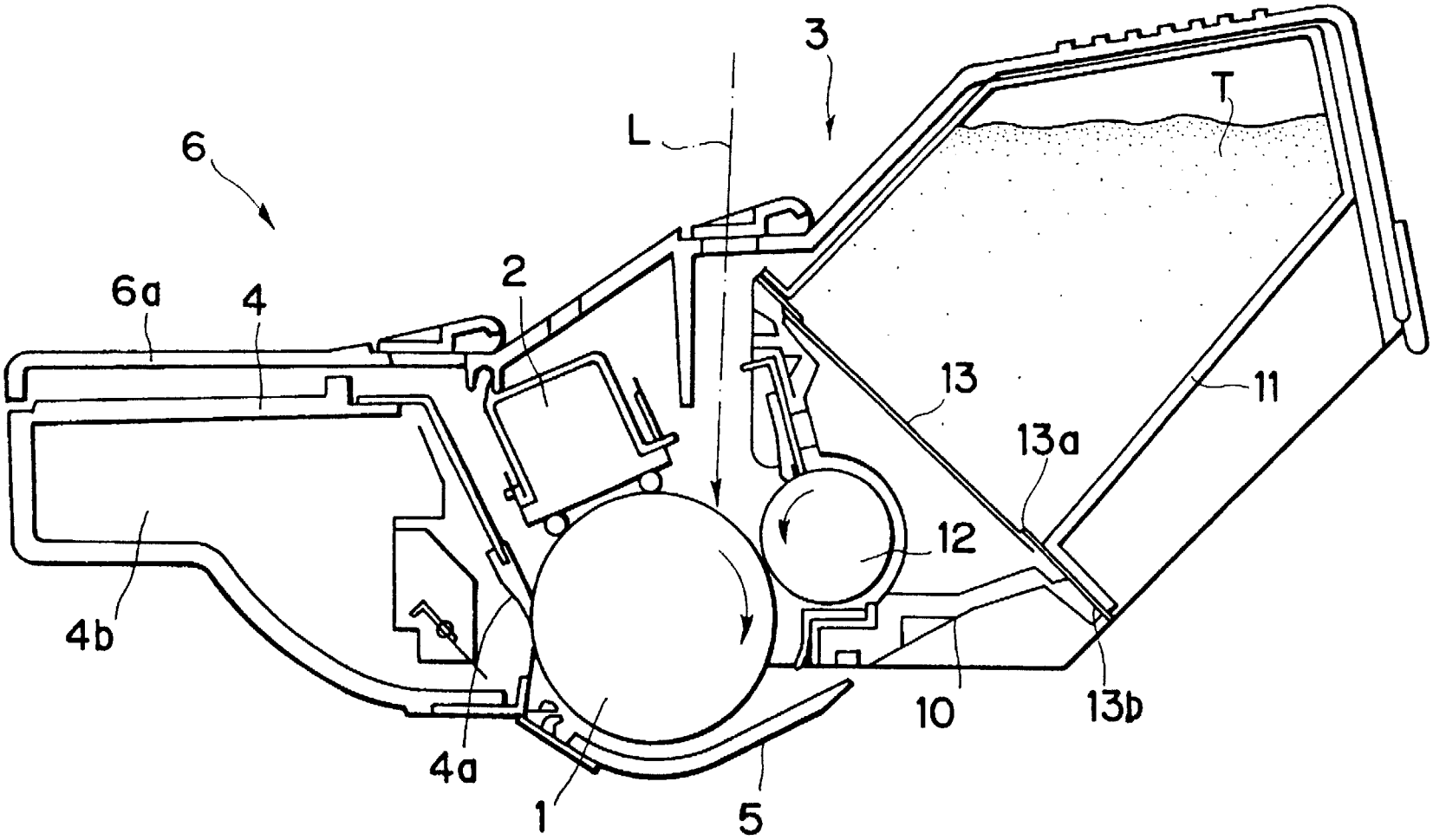
FIG. 1 is a cross-sectional view of a process cartridge employing a photosensitive drum and/or a developing roller of the present invention.

FIG. 1 illustrates a cross-section of a process cartridge 6 provided with a photosensitive drum and/or a developing roller having a cylindrical member according to the present invention. In FIG. 1, a photosensitive drum 1 is an image bearing member which rotates in a predetermined direction. Around the photosensitive drum 1, are provided processing devices including an electrostatic charger 2, a developing device 3, and a cleaning device 4. These devices are assembled integrally in the cartridge case **6*a* which is set to be demountable in the main body of an image-forming apparatus. Therefore, when the life of the photosensitive drum is over, or when the toner (a developing agent) in the developing device 3 has been consumed completely, the processing cartridge 6** is exchanged as a whole, thereby facilitating maintenance.

The developing device 3 faces the photosensitive drum 1, and comprises a developing section 10 having a developing roller 12 as a developing-agent supporter, and a developing agent storing section 11 for storing a toner T and supplying the toner T to the developing section 10. A lid member 13 having an opening **13*a* is provided between the developing section and the toner-storing section. To the opening 13*a* of the lid member 13, a sealer 13*b* is attached so as to prevent the toner T in the developing-agent storing section 11 from leaking through the developing section 10 to the outside of the cartridge 6 during the time when the toner is not used. When the cartridge 6 is mounted on a main body of an image-forming apparatus, the sealer 13*b* is handled to open the opening 13*a* to supply the toner from the developing agent-storing section 11 to the developing section 10**.

The cleaning device 4 is provided for cleaning any remaining toner on the photosensitive drum 1 to make ready the photosensitive drum for subsequent image formation. The cleaning device comprises a cleaning blade **4*a* which slides on the photosensitive drum 1 and removes remaining toner thereon, and a waste toner container 4*b* which stores the waste toner removed by the cleaning blade 4*a***.

A protecting shutter 5 protects the photosensitive drum 1. On mounting the processing cartridge 6 on a main body of an image-forming apparatus, the shutter 5 is displaced to a side of the photosensitive drum 1 (toward the waste toner container).

The photosensitive drum 1 is electrically charged uniformly by the electrostatic charger 2. When the photosensitive drum 1 is exposed to imaging light L from a scanning optical system not shown in the drawing, an electrostatic latent image is formed thereon. This latent image is moved to face the developing device 3 with rotation of the photosensitive drum 1, and is developed to form a toner image with the toner T supplied by the developing roller 12 of the developing device 3. The resulting toner image is transferred onto a transfer-receiving paper sheet by a transfer means not shown in the drawing. The photosensitive drum 1, after the image transfer, is cleaned to remove remaining toner by cleaning device 4 to make ready for subsequent image formation.

The transfer-receiving paper sheet is fed from a paper-feeding cassette, not shown in the drawing, to the photosensitive drum 1, and, after receiving the transferred image, is sent to a fixing device, not shown in the drawing, to fix the toner image.

Figure 2:
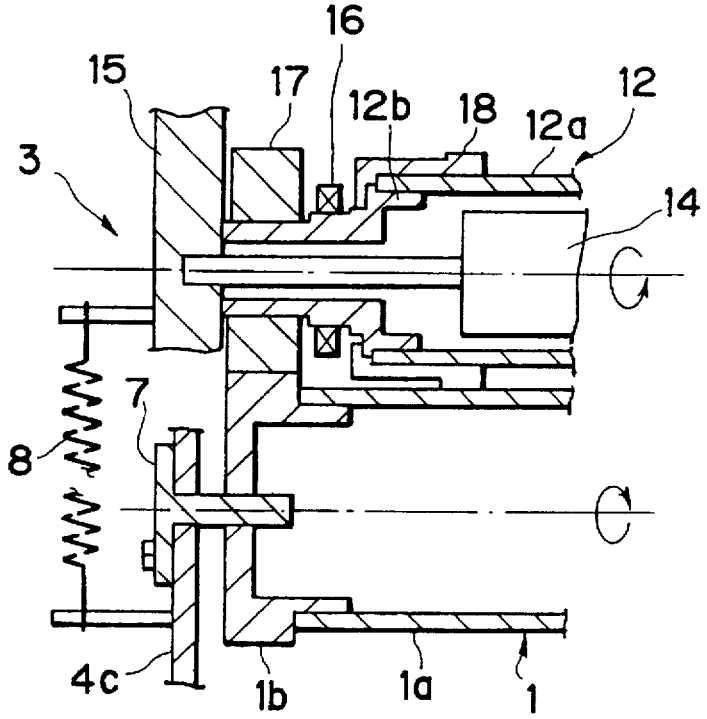
FIG. 2 is a partial cross-sectional view of the process cartridge shown in FIG. 1.

The processing cartridge 6 according to the present invention is explained below in more detail by reference to FIG. 2.

The photosensitive drum 1 comprises a sleeve 1*a* and a gear flange portion 1*b* which are fixed with each other by bonding, and is supported rotatably with a centering axis 7 by the cleaning vessel 4*c*.

The developing device 3 has a magnet roller 14. This magnet roller 14 is held by a magnet holder 15. A developing roller 12, which is provided with a developing roller pipe 12*a*, is held rotatably with a flange 12*b* by a roller bearing 16 which is fixed to a magnet holder 15 by means of a positioning pin/hole means not shown in the drawing. The magnet holder 15 is fixed by a screw to a development vessel not shown in the drawing. At the end portion of the developing roller 12, a spacer roller 18 in a cap shape is fitted rotatably to keep constant the distance from the photosensitive drum 1 outside the development region.

The cleaning vessel 4*c* is supported rotatably around a rotation center (not shown in the drawing) relative to the magnet holder 15, and is energized by a spring 8 in one direction. Therefore, the spacer roller 18 is pressed to the external face of the pipe 1*a* of the photosensitive drum 1 and the distance between the sleeve 12*a* and the sleeve 1*a* of the photosensitive drum 1 is invariably kept constant. A rotational driving force is transmitted to the developing roller gear 17 from a driving gear not shown in the drawing of the main body of an image forming apparatus through the gear flange 1*b* of the photosensitive drum, so that the photosensitive drum 1 and the developing roller 12 rotate respectively in the directions shown by the arrow marks.

Figure 3:
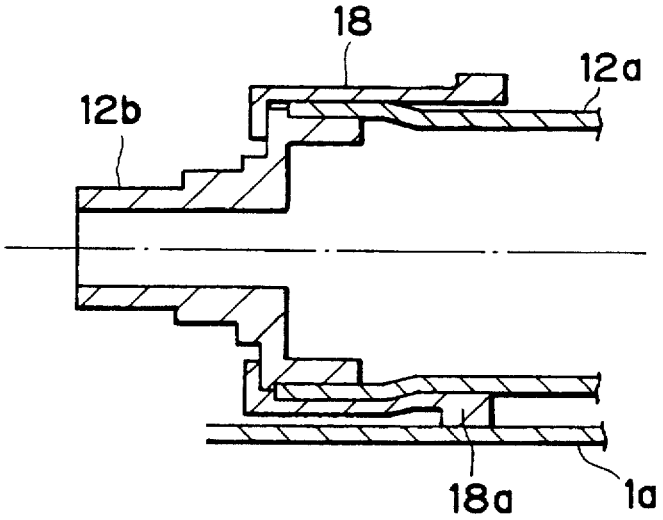
FIG. 3 is a partial cross-sectional view of another embodiment of the developing roller of the present invention.

The invention is explained in more detail by reference to FIG. 3.

The outside diameter of the developing roller flange 12*b* is slightly larger than the inside diameter of the sleeve 12*a*, for example, by about 100 μm, and the developing roller flange 12*b* is press-fitted into the sleeve 12*a* having a smaller inside diameter. If the sleeve 12*a* is made of aluminum and the flange 12*b* is made of a plastic which is softer than aluminum, the outside diameter of the sleeve 12*a* expands, for example, by about 10 μm. However, the length of fitting of the sleeve 12*a* and the flange 12*b* in the axial direction is short, and the expanded portion does not reach the position of the contacting portion 18*a* of the spacer roller 18. Therefore, the distance between the developing roller 12 and the photosensitive drum 1 is controlled to be constant by the thickness of the contacting portion 18*a*. The elasticity of the sleeve 12*a* and the flange 12*b* to restore the original dimensions thereof prevents slipping and separation of sleeve 12*a* and flange 12*b*.

The expansion of the sleeve 12*a* is less than the difference between the thickness of the contacting portion 18*a* and the thickness of the other portion of the spacer roller 18.

If the expanded portion caused by the press-fitting reaches the contacting collar of the spacer roller (i.e., the space-controlling portion), the distance between the photosensitive drum and the developing roller comes to be changed, or otherwise the thickness of the drum-contacting collar of the spacer roller needs to be adjusted to compensate the expansion by estimating the degree of expansion. However, the adjustment is not easy. Therefore, the expanded portion is required not to reach the contacting collar.

Since the sleeve 12*a* and the flange 12*b* are press-fitted without gap, the axes thereof coincide to prevent the swing of the flange 12*b*, as met in prior art, relative to the sleeve 12*a*. Therefore, the position of the magnet roller 14 is invariable. Consequently, the accuracy of bonding of the sleeve and the flange is improved with an economical assembly process, and the lowering of the image quality can be avoided.

Second Embodiment

In the above first embodiment, the sleeve of the developing roller 12 is made of aluminum, and the flange is made of a plastic. In the case where both the sleeve and the flange are made of metal, the same effect can be achieved as long as the elasticity of the metal prevents the slipping and falling-out of the flange and the amount of the expansion of the sleeve is less than the difference between the thickness of the contacting collar and the thickness of the other portion of the spacer roller.

It is preferred, however, to select a hard material such as aluminum, stainless steel, and other metals for the sleeve, and a soft material such as a plastic for the flange from the standpoint of reducing the expansion of the sleeve.

Third Embodiment

Figure 4:
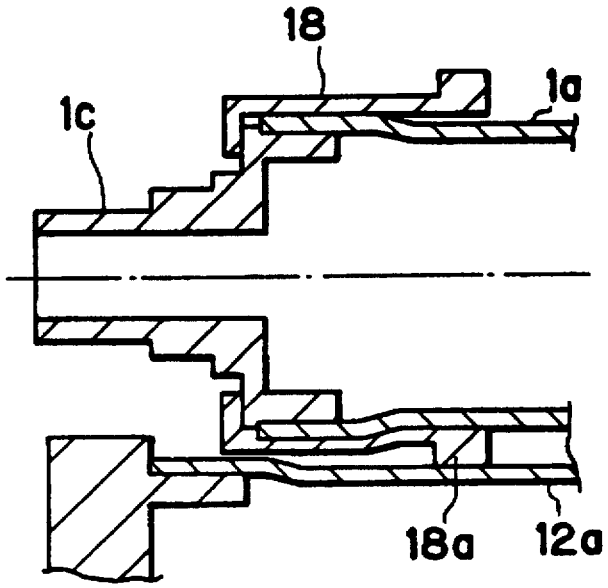
FIG. 4 is a partial cross-sectional view of a photosensitive drum according to a third embodiment of the present invention.
Figure 5:
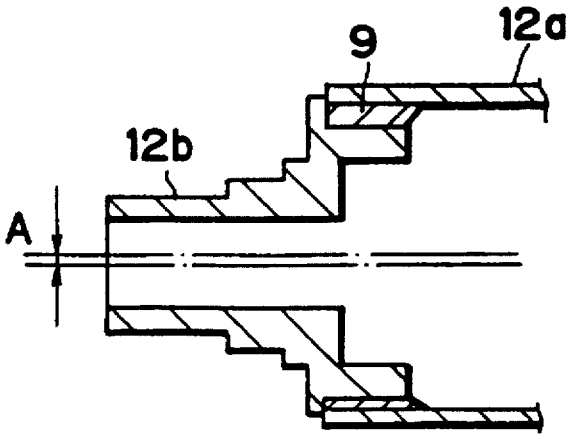
FIG. 5 PRIOR ART
FIG. 5 is a partial cross-sectional view of a conventional cylindrical member.

In the above embodiments, the description is made regarding the developing roller. The photosensitive drum may also be provided according to the present invention. This is shown by FIG. 4. In this embodiment, the developing roller 12 is the same as in the above embodiments, and the explanation therefor is not repeated here.

In this embodiment also, the gear flange 1*c* is press-fitted into the sleeve 1*a* of the photosensitive drum 1, and the expanded portion of the sleeve does not reach the contacting portion 18*a* of the spacer roller 18, whereby the assembly process is simplified and the bonding is stabilized.

In an electrophotographic apparatus employing a developing roller or a photosensitive drum of the present invention, two or more of the constituting elements such as a photosensitive member, a developing means, and a cleaning means may be integrated into one unit as shown in FIG. 1, and the unit may be made demountable from the main body of the apparatus. For example, at least one of the electrostatic charging means, the developing means, and the cleaning means is integrated with the photosensitive member into one unit which is made demountable from the main body of the apparatus by aid of a guiding means such as a rail in the main body of the apparatus. The device unit may comprise the electrostatic charging means and/or the developing means.

In the case where the electrophotographic apparatus is used as a copying machine or a printer, the optical image exposure light may be projected onto the photosensitive member as reflected light or transmitted light from an original copy, or otherwise the information read out from an original may be signalized, and light is projected, onto a photosensitive member, by scanning with a laser beam, driving an LED array, or driving a liquid crystal shutter array according to the signal.

Figure 6:
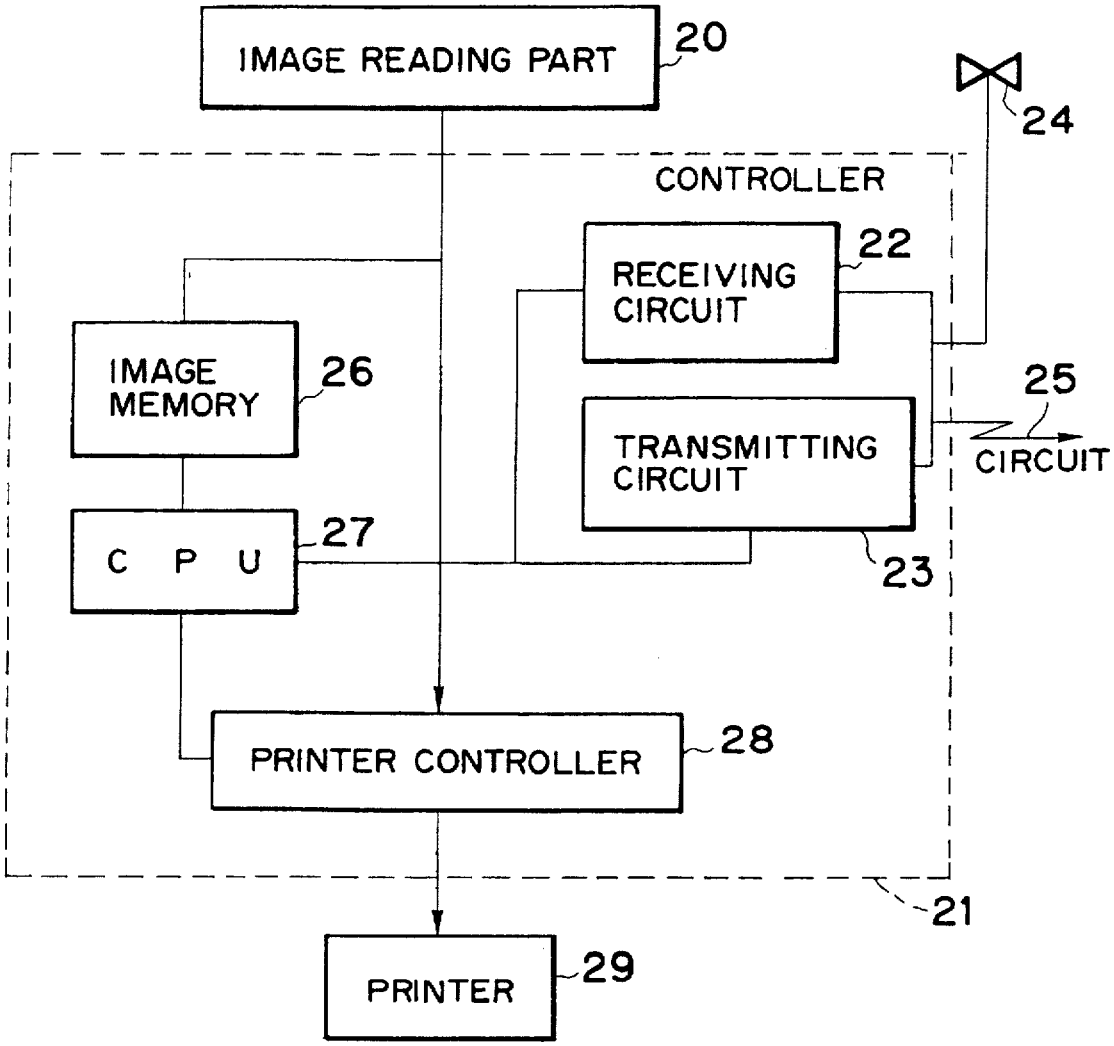
FIG. 6 is a block diagram of a facsimile system employing an electrophotographic apparatus as the printer in which a cylindrical member of the present invention is used.

In the case where the electrophotographic apparatus is used as a printer of a facsimile machine, the optical image exposure light is employed for printing the received data. FIG. 6 is a block diagram of an example of this case.

A controller 21 controls the image-reading part 20 and a printer 29. The entire controller 21 is controlled by a CPU 27. Readout data from the image reading part 20 is transmitted through a transmitting circuit 23 to the other communication station. Data received from the other communication station is transmitted through a receiving circuit 22 to a printer 29. The image data is stored in image memory 26. A printer controller 28 controls a printer 29. The numeral 24 denotes a telephone set.

The image received through a circuit 25, namely image information from a remote terminal connected through the circuit, is demodulated by the receiving circuit 22, treated for decoding of the image information in CPU 27, and successively stored in the image memory 26. When at least one page of image information has been stored in the image memory 26, the images are recorded in such a manner that the CPU 27 reads out the one page of image information, and sends out the decoded one page of information to the printer controller 28, which controls the printer 29 on receiving the one page of information from CPU 27 to record the image information.

During recording by the printer 29, the CPU 27 receives the subsequent page of information.

Images are received and recorded in the manner as described above.

What is claimed is:

1. A cylindrical member comprising a sleeve, a flange bonded to an end portion of said sleeve, and a space-controlling member provided at the end portion of said sleeve, in which a press-fitted portion of said flange is press-fitted into the end portion of said sleeve to be bonded thereto, and a space-controlling and contacting portion of said space-controlling member contacts an outer side of said sleeve and is located farther from an end of said sleeve at the end portion thereof than the press-fitted portion of said flange.

2. A cylindrical member according to claim 1, wherein a difference between an inside diameter of the sleeve and an outside diameter of the flange is 5 μm to 150 μm.

3. A cylindrical member according to claim 1, wherein expansion of the sleeve caused by press-fitting of the flange does not reach the space-controlling portion of the space-controlling member.

4. A cylindrical member according to claim 1, wherein the flange is made of a material softer than that of the sleeve.

5. A cylindrical member according to claim 4, wherein the flange is made of a plastic and the sleeve is made of a metal.

6. A cylindrical member according to any of claims 1 to 5, wherein the cylindrical member is a developing roller.

7. A cylindrical member according to any of claims 1 to 5, wherein the cylindrical member is a photosensitive drum.

8. An electrophotographic apparatus comprising a developing roller and a photosensitive drum; the developing roller comprising a sleeve, a flange having a press-fitted portion press-fitted into an end portion of said sleeve, and a space-controlling member provided at the end portion of said sleeve, a space-controlling and contacting portion of said space-controlling member being located farther from an end of an outer side of said sleeve than the press-fitted portion of said flange, and said photosensitive drum being press-contacted to the space-controlling and contacting portion.

9. An electrophotographic apparatus according to claim 8, wherein a difference between an inside diameter of the sleeve and an outside diameter of the flange is 5 μm to 150 μm.

10. An electrophotographic apparatus according to claim 8, wherein expansion of the sleeve caused by press-fitting of the flange does not reach the space-controlling portion of the space-controlling member.

11. An electrophotographic apparatus according to claim 8, wherein the flange is made of a material softer than that of the sleeve.

12. A facsimile machine comprising an electrophotographic apparatus comprising a developing roller and a photosensitive drum, and an information-receiving means for receiving information from a remote terminal; said developing roller comprising a sleeve, a flange having a press-fitted portion press-fitted into an end portion of said sleeve, and a space-controlling member provided at the end portion of said sleeve, a space-controlling and contacting portion of said space-controlling member being located farther from an end of an outer side of said sleeve than the press-fitted portion of said flange, and said photosensitive drum being press-contacted to the space-controlling and contacting portion.

13. An electrophotographic apparatus comprising a photosensitive drum and a developing-agent-supporter; said photosensitive drum comprising a sleeve, a flange having a press-fitted portion press-fitted into an end portion of said sleeve, and a space-controlling member provided at the end portion of said sleeve; a space-controlling and contacting portion of said space-controlling member being located between the press-fitted portion of said flange and a developing region on a peripheral face of said photosensitive drum, and said developing-agent-supporter being press-contacted to the space-controlling and contacting portion.

14. An electrophotographic apparatus according to claim 13, wherein a difference between an inside diameter of the sleeve and an outside diameter of the flange is 5 μm to 150 μm.

15. An electrophotographic apparatus according to claim 13, wherein expansion of the sleeve caused by press-fitting of the flange does not reach the space-controlling portion of the space-controlling member.

16. An electrophotographic apparatus according to claim 13, wherein the flange is made of a material softer than that of the sleeve.

17. A facsimile machine comprising a photosensitive drum, a developing-agent-supporter, and an information-receiving means for receiving image information from a remote terminal; said photosensitive drum having a sleeve, a flange having a press-fitted portion press-fitted into an end portion of said sleeve, and a space-controlling member provided at the end portion of said sleeve; a space-controlling and contacting portion of said space-controlling member being located between the press-fitted portion of said flange and a developing region on a peripheral face of said photosensitive drum, and said developing-agent-supporter being press-contacted to the space-controlling and contacting portion.

18. A process cartridge which is set to be demountable in the main body of an image forming apparatus, comprising a developing roller and a photosensitive member, said developing roller being assembled integrally in the cartridge;

wherein said developing roller comprises a sleeve; a flange having a press-fitted portion press-fitted into an end portion of said sleeve; and a space-controlling member provided at the end portion of said sleeve, a space-controlling and contacting portion of said space-controlling member being located farther from an end of an outer side of said sleeve than the press-fitted portion of said flange, and said photosensitive drum being press-contacted to the space-controlling and contacting portion.

19. A process cartridge according to claim 18, wherein expansion of the sleeve caused by press-fitting of the flange does not reach the space-controlling portion of the space-controlling member.

20. A developing device comprising a developing roller and a developing agent storing section, wherein said developing roller comprises a sleeve; a flange having a press-fitted portion press-fitted into an end portion of said sleeve; and a space-controlling member provided at the end portion of said sleeve, a space-controlling and contacting portion of said space-controlling member being located farther from an end of an outer side of said sleeve than the press-fitted portion of said flange.

21. A developing device according to claim 20, wherein expansion of the sleeve caused by press-fitting of the flange does not reach the space-controlling portion of the space-controlling member.

* * * * *

UNITED STATES PATENT AND TRADEMARK OFFICE

CERTIFICATE OF CORRECTION

PATENT NO. : 5,594,531

DATED : January 14, 1997

INVENTOR(S) : KAZUO SHISHIDO, ET AL.

It is certified that error appears in the above-indentified patent and that said Letters Patent is hereby corrected as shown below:

COLUMN 2:

Line 51, "more" should read --farther--.

COLUMN 4:

Line 16, delete "of";
Line 44, "developing-agent supporter," should read --developing-agent-supporter,--;
Line 50, "developing-agent storing" should read --developing-agent-storing--; and
Line 55, "developing" should read --developing- --.

COLUMN 5:

Line 48, "gear not" should read --gear, not--, and "drawing of" should read --drawing, of--.

COLUMN 6:

Line 19, "without" should read --without a--.

Signed and Sealed this

First Day of July, 1997

Bruce Lehman

*Attest:*

BRUCE LEHMAN

*Attesting Officer*

*Commissioner of Patents and Trademarks*